US007451912B1

(12) United States Patent
Taube, II

(10) Patent No.: US 7,451,912 B1
(45) Date of Patent: Nov. 18, 2008

(54) VARIABLE WIDTH MAILBOX TRAY

(76) Inventor: Frank A. Taube, II, 6160 Mariner Sands Dr., Stuart, FL (US) 34997

( * ) Notice: Subject to any disclaimer, the term of this patent is extended or adjusted under 35 U.S.C. 154(b) by 0 days.

(21) Appl. No.: 12/033,573

(22) Filed: Feb. 19, 2008

Related U.S. Application Data

(60) Provisional application No. 60/890,852, filed on Feb. 21, 2007.

(51) Int. Cl.
*A47G 29/12* (2006.01)

(52) U.S. Cl. ..... 232/29; 232/17

(58) Field of Classification Search ..... 232/29, 232/17, 33; 211/175; 220/8, 23.87; 206/557
See application file for complete search history.

(56) References Cited

U.S. PATENT DOCUMENTS 2,369,728 A * 2/1945 Lorraine ..... 294/168
3,140,777 A * 7/1964 Gordan ..... 206/315.1
3,463,343 A * 8/1969 Asenbauer ..... 220/8
4,500,146 A * 2/1985 Peterson ..... 312/257.1
4,753,385 A * 6/1988 Phipps et al. ..... 232/17
5,009,366 A * 4/1991 van Druff et al. ..... 232/17
5,207,405 A * 5/1993 Cobb ..... 248/411
5,366,099 A * 11/1994 Schmid ..... 211/59.3
5,765,749 A * 6/1998 Harper ..... 232/17
6,915,947 B2 * 7/2005 Siurek et al. ..... 229/101
7,000,826 B2 * 2/2006 Billings ..... 232/29
7,172,163 B1 * 2/2007 Johnson ..... 248/146
2006/0022028 A1 * 2/2006 Thomas ..... 232/29

* cited by examiner

*Primary Examiner*—William L. Miller
(74) *Attorney, Agent, or Firm*—Steve M. Clemmon

(57) ABSTRACT

A tray adapted to fit within a conventional mailbox. The tray includes a flat elongated center body and two side members, each having perpendicular short and tall walls. The tray is adjustable to accommodate a variety of mailbox interior sizes, such that the side walls of the tray are both proximate to the interior side walls of the mailbox. Adjustment slots in the center body allow the side members to slide laterally to fit the width of the mailbox. Either the short walls or the tall walls of the side members can coupled to the body to increase the range of widths of the tray.

22 Claims, 5 Drawing Sheets

VARIABLE WIDTH MAILBOX TRAY

CROSS REFERENCE TO RELATED APPLICATION

This application claims the benefit of U.S. Provisional Patent Application Ser. No. 60/890,852, filed Feb. 21, 2007, the disclosure of which is expressly incorporated by reference herein.

FIELD OF THE INVENTION

The present invention relates to containers and trays and, more particularly, to a tray having a variable width that is adapted to slidably fit within a mailbox.

BACKGROUND OF THE INVENTION

Conventional rural or curbside mailboxes are relatively deep, which makes it nearly impossible for an individual to reach to the back to retrieve all the mail and packages contained therein. This is particularly so when the person is attempting to retrieve their mail while remaining inside of a vehicle. Stepping out of the vehicle can be inconvenient, potentially dangerous, and if the weather is cold, raining or snowing, uncomfortable.

There have been other trays that have been used within mailboxes and which receive the mail deposited into the mailbox. These trays allow a user to pull the tray partially out of the mailbox opening and retrieve the mail contained within the tray. While these trays do allow for the relatively easy retrieval of mail deposited within some mailboxes they suffer from certain drawbacks.

Particularly, these prior art trays are normally rigid trays or troughs that are simply small enough to fit within a particular mailbox. Examples of these types of rigid trays are described in U.S. Pat. Nos. 4,600,143; 5,083,703; 5,765,749; and U.S. Design Pat. No. D438,688. These rigid trays, however, cannot be custom fit to the size of a particular mailbox. At this time there are over fifty mailboxes approved by the United States Postal Service in varying sizes. A rigid tray will only be effective within a small range of sizes. Mail may be lost or delayed if a tray is used that is too small for a particular mailbox and leaves a sizable gap between the mailbox and the tray. A piece of mail may fall within this gap and could lie undiscovered for a length of time. Further, using a tray that is significantly narrower than the mailbox effectively results in the tray greatly reducing the usable space in the mailbox and could prevent larger articles or mail or packages from fitting within the mailbox. It is therefore desirable to have a tray that has a variable width to accommodate various-sized mailboxes.

Other trays have been used within mailboxes that may be folded along one of a plurality of pre-formed joints to allow a user to custom fit the tray to a particular mailbox. Examples of these types of folded trays are described in U.S. Pat. Nos. 4,753,385 and 5,009,366. These foldable units, however, rely on materials, such as cardboard or thin sheets of plastic that allow the user to easily form the tray. These materials are oftentimes not durable and can be easily broken or torn. Additionally, bending the material to form the joints inherently creates weak points in the tray, which may fail or tear thereby ruining the tray.

The present invention overcomes these and other disadvantages of prior art mailbox trays by providing a durable adjustable size mailbox tray.

SUMMARY OF THE INVENTION

The broad purpose of the present invention is to provide a mailbox tray that is adjustable in size to accommodate and fit within substantially any mailbox. In the preferred embodiment of the invention, a central body section is slidably coupled to two side members to cooperatively define a mail-receiving trough. The central body includes a plurality of slots that receive fasteners which couple the side members to the body and allow the side members to slide relative to the stationary body. In one embodiment, the fasteners along the bottom surface also function as feet which offset the body and side members from the floor of the mailbox and facilitate sliding of the tray within the mailbox.

It is an advantage of the present invention to provide a mailbox tray having a pair of multi-position side walls that allow a user to vary the width of the tray to fit within substantially any mailbox.

It is another advantage of the present invention that the two side members have two elongated walls of different heights. Either of these walls can be slidably coupled to the central body to further increase the range of tray widths. If the shorter wall is coupled to the body, the tray can be made narrower, while the tray can be made wider by coupling the taller wall to the body.

It is still another advantage of the present invention that the tray can be easily assembled and customized to fit within a broad range of mailbox widths, while keeping the side walls of the tray proximate to the inner walls of the mailbox to maximize capacity and avoid losing articles of mail between the side walls and the mailbox.

It is yet another advantage of the present invention that the variable width of the tray reduces the number of sizes need to be in a seller's inventory and reduces the number of molds needed to produce a range of sizes.

It is still yet another advantage of the present invention that the variable width of the tray eliminates the need of a customer to pre-measure his mail box prior to purchasing or ordering the tray.

Still further objects and advantages of the invention will become readily apparent to those skilled in the art to which the invention pertains upon reference to the following detailed description.

BRIEF DESCRIPTION OF THE DRAWINGS

The description refers to the accompanying drawings in which like reference characters refer to like parts throughout the several views; and in which.

DETAILED DESCRIPTION OF THE INVENTION

Figure 1:
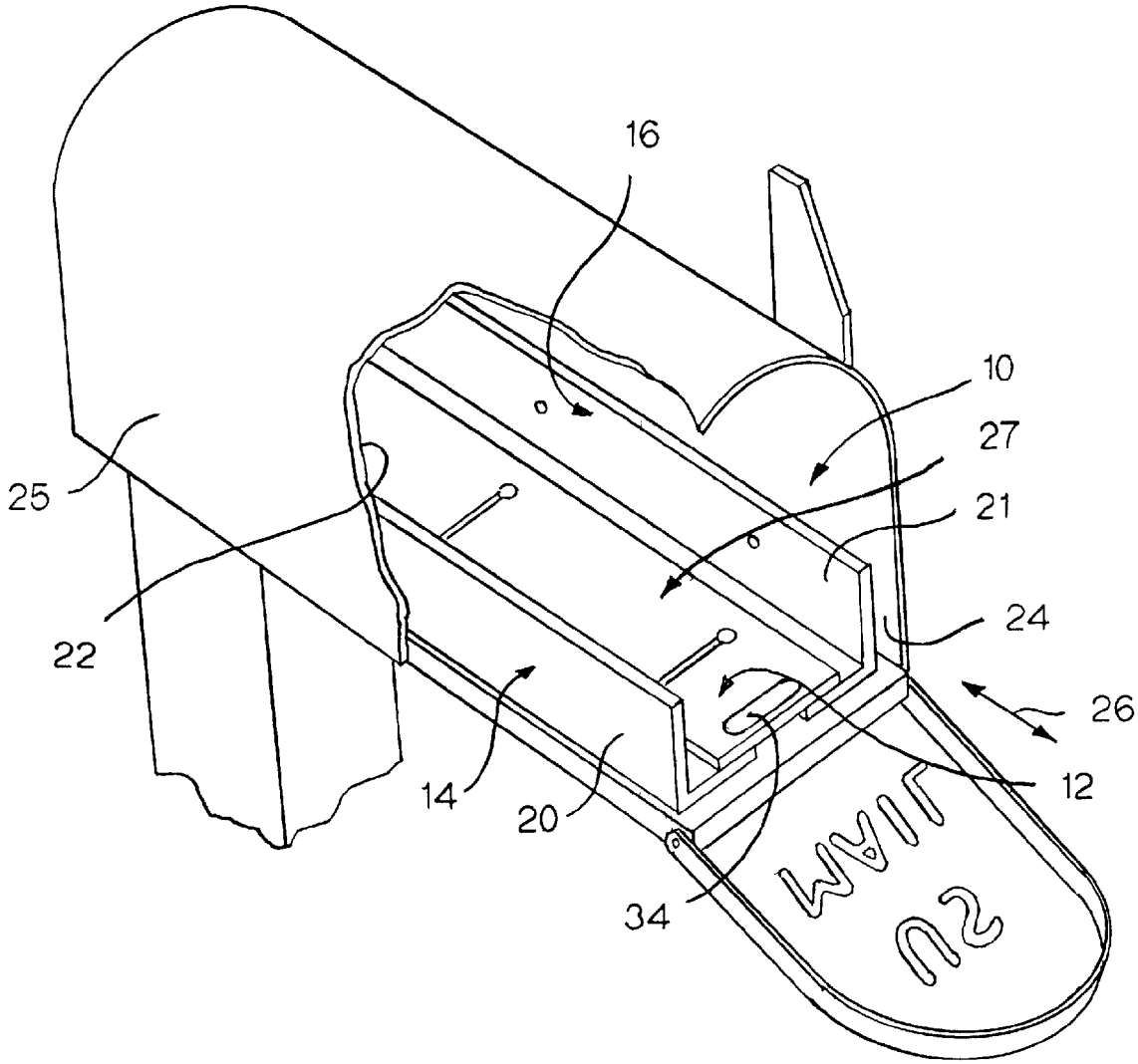
FIG. 1 is a partial cutaway perspective view of the mailbox tray disposed within a curbside mailbox.
Figure 2:
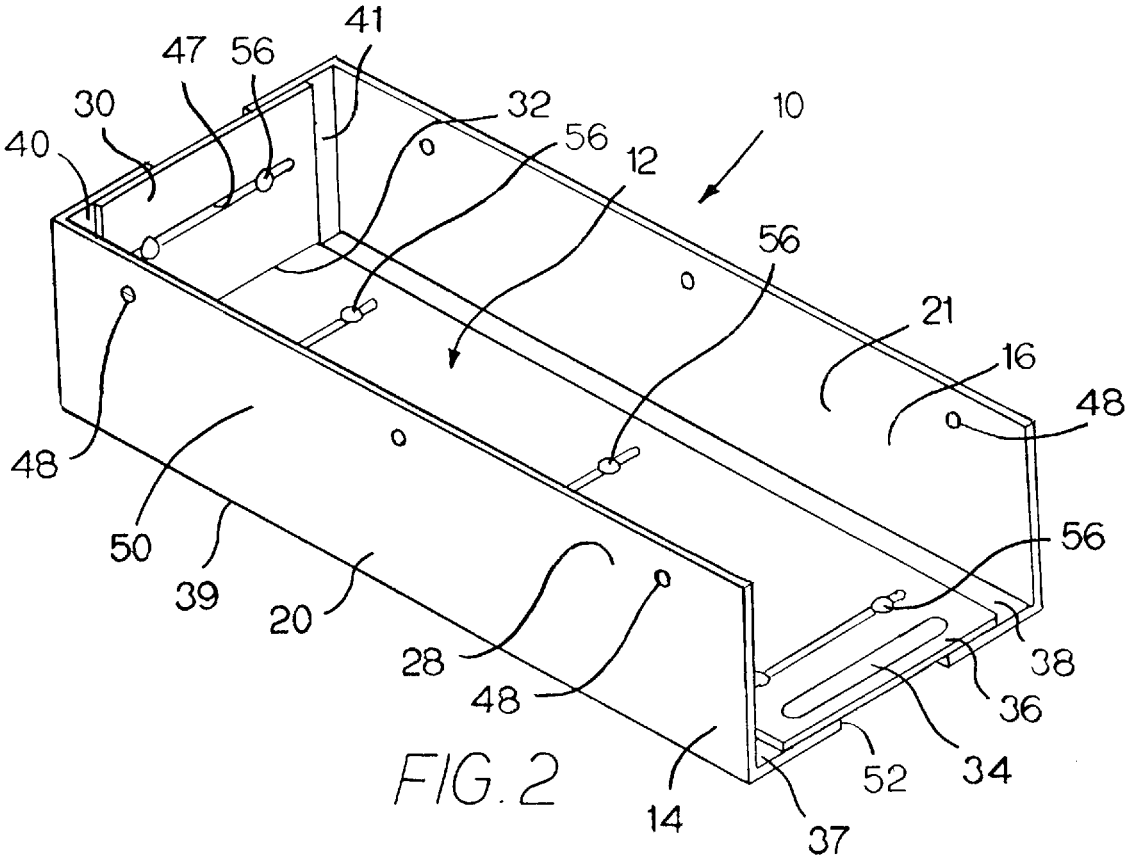
FIG. 2 is a perspective view of the mailbox tray.
Figure 3:
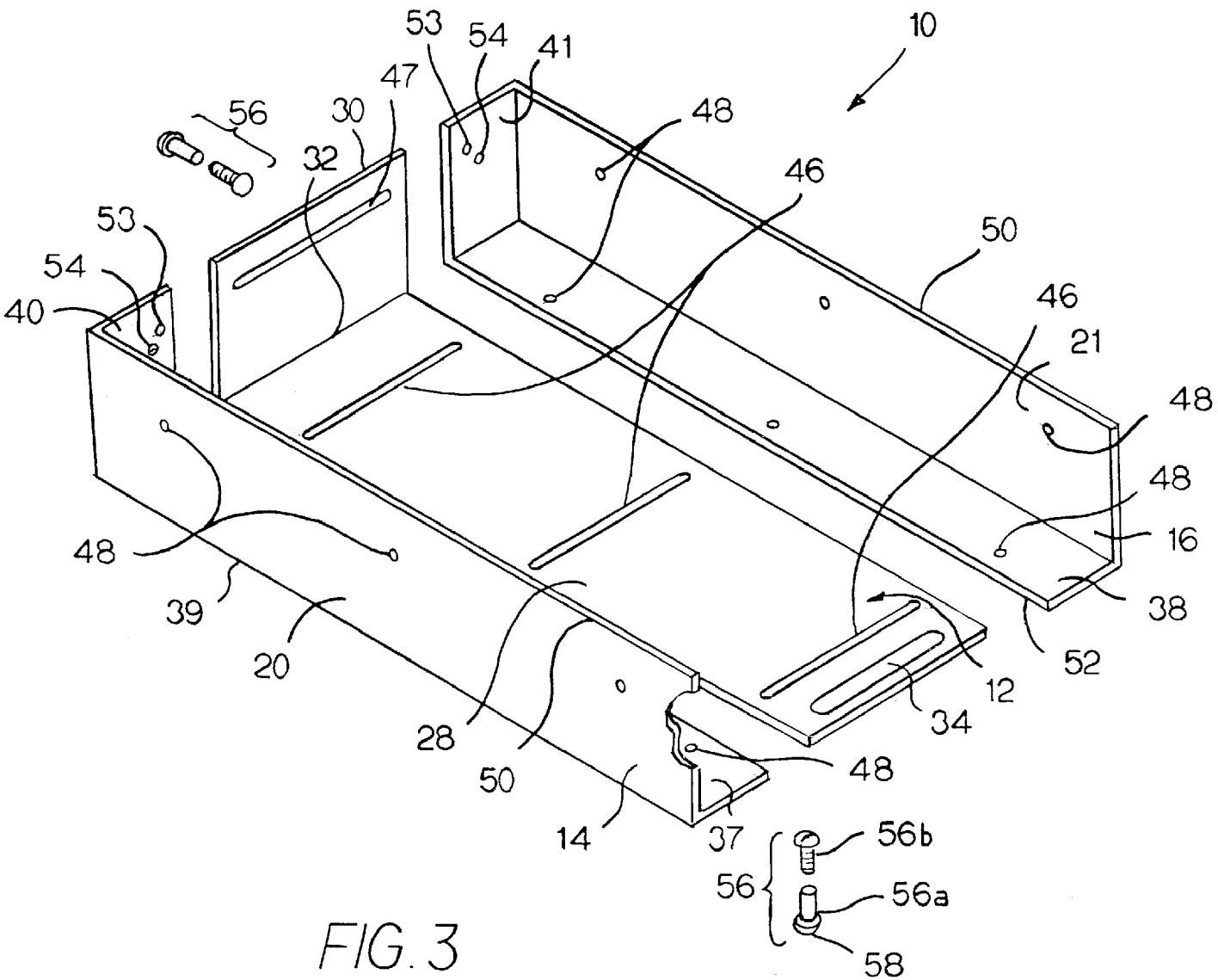
FIG. 3 is an exploded view of the mailbox tray.

Referring now to FIGS. 1-3, an improved mailbox tray 10 is shown. Tray 10 comprises three slidably coupled sections, including a central body section 12, and two side sections or members 14 and 16. Tray 10 is adapted whereby side sections 14, 16 are couple to body 12 in a manner such that the vertically disposed walls (walls 20, 21 in FIG. 1) of sides 14, 16 are proximate to the side walls 22, 24 of a conventional mailbox 25, while allowing mailbox tray 10 to slide in and out of the mailbox 25 in the directions of arrow 26. A mail-receiving cavity 27 is defined by the body 12 and the vertical walls of member 14, 16.

Central body 12 includes a generally rectangular elongated base strip 28 and a rear wall 30 that extends perpendicularly from the rear edge 32 of strip 28.

In one embodiment, strip 28 is approximately eighteen inches long and 5½ inches wide, while rear wall 30 has the same width as strip 28 and is four inches tall.

Strip 28 includes means 34 for grasping the front end 36 of central body 12. In the preferred embodiment, grasping means 34 is a slot having a rounded rectangle (i.e., oval) shape, which is formed through strip 28. In this embodiment, this slot 34 is both proximate to and runs generally parallel to the front edge of strip 28. This slot 34 is sized to permit a person's fingers to fit within it and thereby grasp the body 12. In other embodiments, grasping means 34 may be finger holes or a small handler extending from the front end 36 of the tray.

Side sections 14 and 16 are preferably mirror images of each other and each include two elongated walls 20, 37 and 21, 38. These walls 20, 37 and 21, 38 are joined perpendicularly along one longitudinal edge or corner 39 to form a generally "L-shaped" cross-section. The joined walls 20, 37 and 21, 38 have differing heights whereby walls 20 and 21 are "tall", while walls 37 and 38 are "short". These differing wall heights, as will be described in greater detail below, allow for a larger range of widths that the tray 10 may be adjusted to. In one embodiment, tall walls 20, 21 each has a height of approximately four inches, while short walls 37, 38 each has a height (i.e., width in FIGS. 1-3) of approximately three inches. Both sets of walls 20, 37 and 21, 38 are approximately the same length as strip 28. In the preferred embodiment, these side section walls 20, 21, 37, 38 are slightly longer than strip 28. This longer length compensates for rear wall thicknesses when the sections 12, 14, 16 are assembled, such that the front edges of the sections 12, 14, 16 present a uniform front edge.

A rectangular rear wall 40, 41 projects from the rear edges of walls 20, 37 and 21, 38, respectively. Rear walls 40, 41 have a height and width which is equal to the widths of the two adjoining two walls 20, 37 and 21, 38.

Each section 12-16 of tray 10 is preferably formed from a relatively thin contiguous piece of lightweight and durable material, such as high-density polyethylene (HDPE). In the preferred embodiment each wall of the various tray sections 12-16 are uniform in thickness and in one example, the walls are all approximately ¼ inch thick.

As best shown in FIG. 3, central body 12 and side members 14, 16 also include means for slidably coupling these sections together. A sliding relationship between the body and sides sections of tray 10 allows the tray to be adjusted to varying widths to fit the tray within mailboxes of different widths. In the preferred embodiment, the means for adjusting the tray width includes a plurality of parallel adjustment slots 46 formed through strip 28 and slot 47 formed through rear wall 30. Each slot 46, 47 runs perpendicular to the longitudinal axis of the strip 28. In the preferred embodiment, three equally spaced slots 46 are formed along the length of strip 28, while one slot 47 is formed in rear wall 30. In other embodiments, slots 46, 47 may be replaced with a line of holes or a grid pattern.

The means for adjusting the tray width also comprises a plurality of apertures 48 formed within each of the side walls 20, 37 and 21, 38 of side sections 14, 16. These apertures 48 are formed within the walls proximate to the edges 50, 52 opposite to wall-mating corner 39.

Each wall 20, 37 and 21, 38 includes the same number of apertures 48 as slots 46 formed in strip 28. Each aperture 48 is also aligned with a corresponding slot 46, such that when strip 28 is laid over either of the walls 20, 37 or walls 21, 38 and rear walls 30, 40, and 41 abut, then each aperture 48 in the overlaid side wall 14, 16 is aligned with and coextensive to one of the slots 46.

Figure 4:
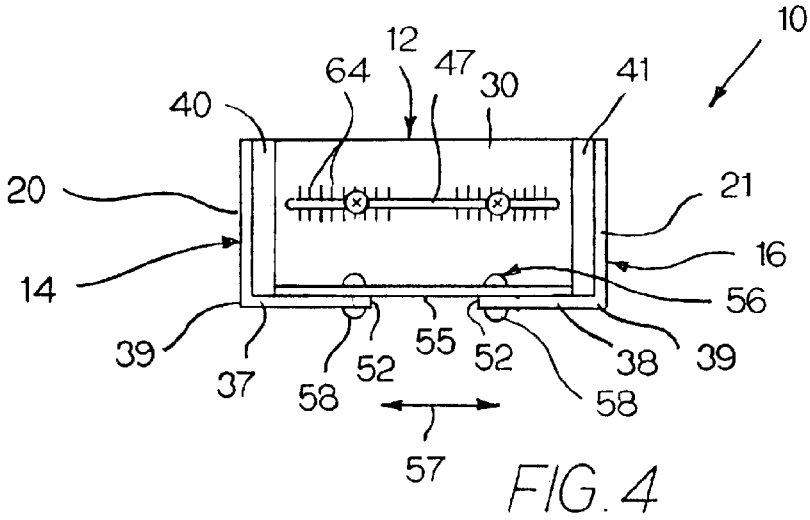
FIG. 4 is a front view of the mailbox tray having the side members coupled to the body to form a narrow configuration.
Figure 5:
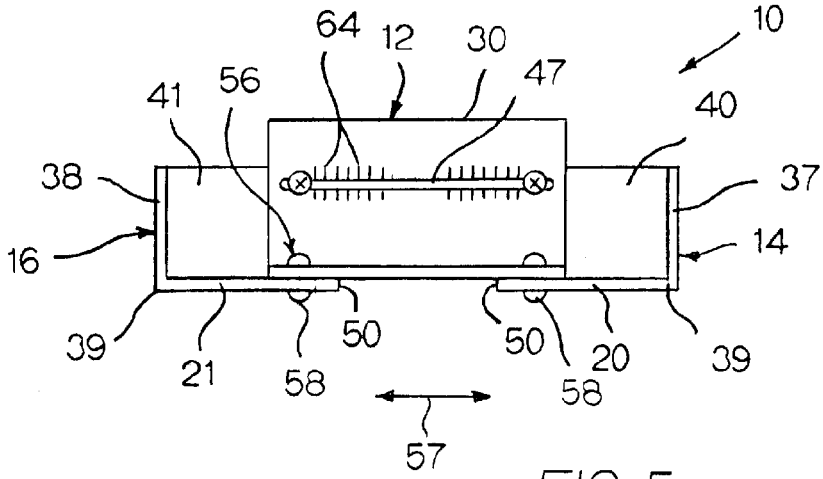
FIG. 5 is a front view of the mailbox tray having the side members coupled to the body to form a wide configuration.

Referring now to FIGS. 3-5, each rear wall 40 also includes a pair of through apertures 53, 54 which are substantially the same as apertures 48. Aperture 53, 54 are located within the respective rear walls 40 of side sections 14 and 16 to allow these side sections to be coupled to body 12 with either the tall wall 20, 21 or the short wall 37, 38 in a vertical position (i.e., operating as the side wall of the tray 10). Each pair of apertures 53, 54 are located such that one of the two apertures is aligned with rear slot 47.

It should be appreciated that for this patent application the terms "aligned" or "aligned with" describe when the inner wall of an aperture, such as apertures 48, 53, and 54, is substantially coextensive with the inner walls of one of the slots formed in the body 12 and that these inner walls are substantially parallel.

Figure 6:
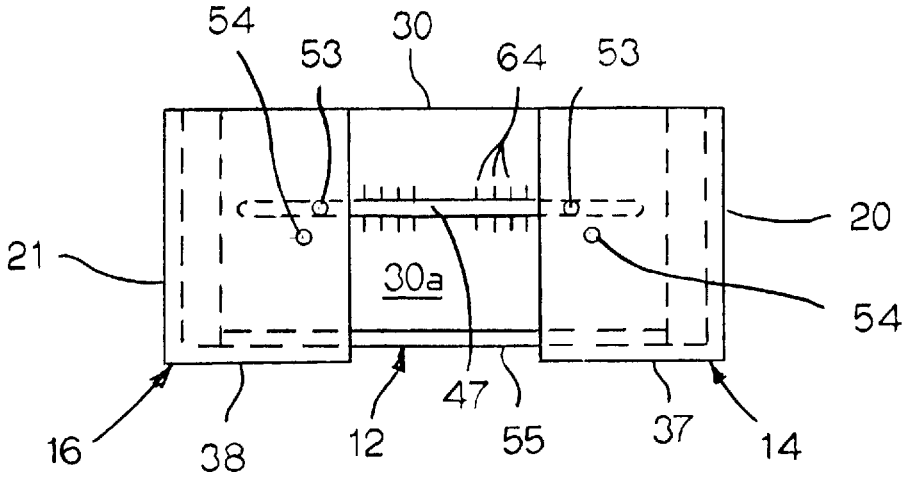
FIG. 6 is a rear view of the mailbox tray illustrating the dual alignment holes in the side members.

As shown in FIGS. 4 and 6, when the side sections 14, 16 are oriented having their tall walls 20 in a vertical position, aperture 53 is aligned with slot 47 in rear wall 30 of body 12. In this narrow tray/tall walls configuration, short walls 37, 38 abut the bottom surface 55 of strip 28.

Additionally, as shown in FIG. 5, when side sections 14, 16 are oriented having their short walls 37, 38 in a vertical position, aperture 54 is aligned with slot 47 in rear wall 30. In this wide tray/short walls configuration, tall walls 20, 21 abut the bottom surface 50 of strip 28.

Side sections 14 and 16 are removably coupled to body 12 by a plurality of threaded fasteners 56. Each fastener 56 preferably is a complementary sex bolt set where the female portion **56*a* includes an internally threaded shaft that is sized to fit within apertures 48 and slots 46 and within apertures 53, 54 and slot 47. A male portion 56*b* is threadably received within female portion 56*a*. Each fastener 56 may be selectively tightened to fix the sections 12-16 in a certain position, while allowing the sides 14, 16 to slide relative to the body 12 in the directions of arrow 57. In the preferred embodiment, the female portion 56*a* of fastener 56 includes an enlarged head or foot 58 having a curved or rounded bottom surface. The rounded foot 58 extends from the underside of tray 12 and operates as a spacer that the tray 12 rests upon. Similar fasteners 56 couple the rear walls 30, 40, and 41** through their aligned slots and apertures. It should be appreciated that substantially any type of reusable fastener, such as conventional nuts and bolts, may be used in place of the sex bolt configuration disclosed herein.

It should be appreciated that when tray 10 is assembled having short walls 37, 38 operating as the outer or side walls of the tray, as shown in FIG. 5, the tray 10 may be adjusted to a greater width than when the tray 10 is assembled in the configuration illustrated in FIG. 4.

Figure 7:
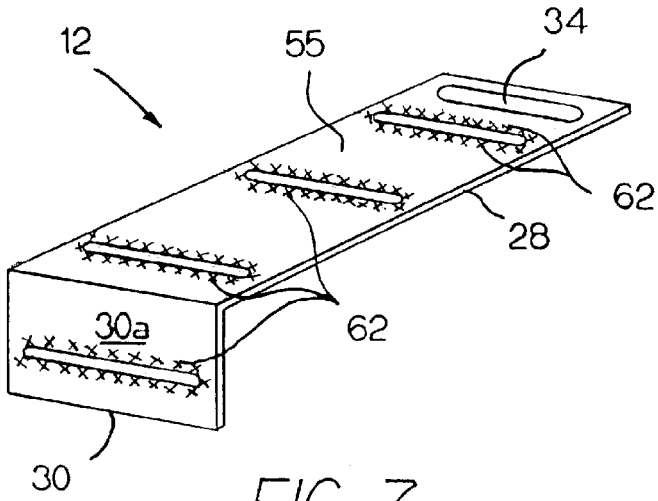
FIG. 7 is a view showing the bottom and back surfaces of the body section.

Referring now to FIG. 7, in one embodiment of the invention, the bottom surface 55 of strip 28 and rear surface **30*a* of wall 30 have a rough texture (e.g., have a slightly raised or knurled surface) in the area 62 adjacent to each of the slots 46, 47. In operation, these roughened areas 62 increase the friction between the body 12 and side sections 14, 16 to assist in maintaining the sections 12-16** in position during assembly and when the sections are fastened together.

In another embodiment, illustrated in FIGS. 4-6, scored alignment lines 64 are impressed into body 12 perpendicular-to and running along the length of the adjustment slots 46, 47. These alignment lines 64 provide a reference to a user assembling the tray 10 to ensure that side members 14, 16 are parallel to the elongated body 12. Therefore the width is equal over the length of tray 12.

Figure 8:
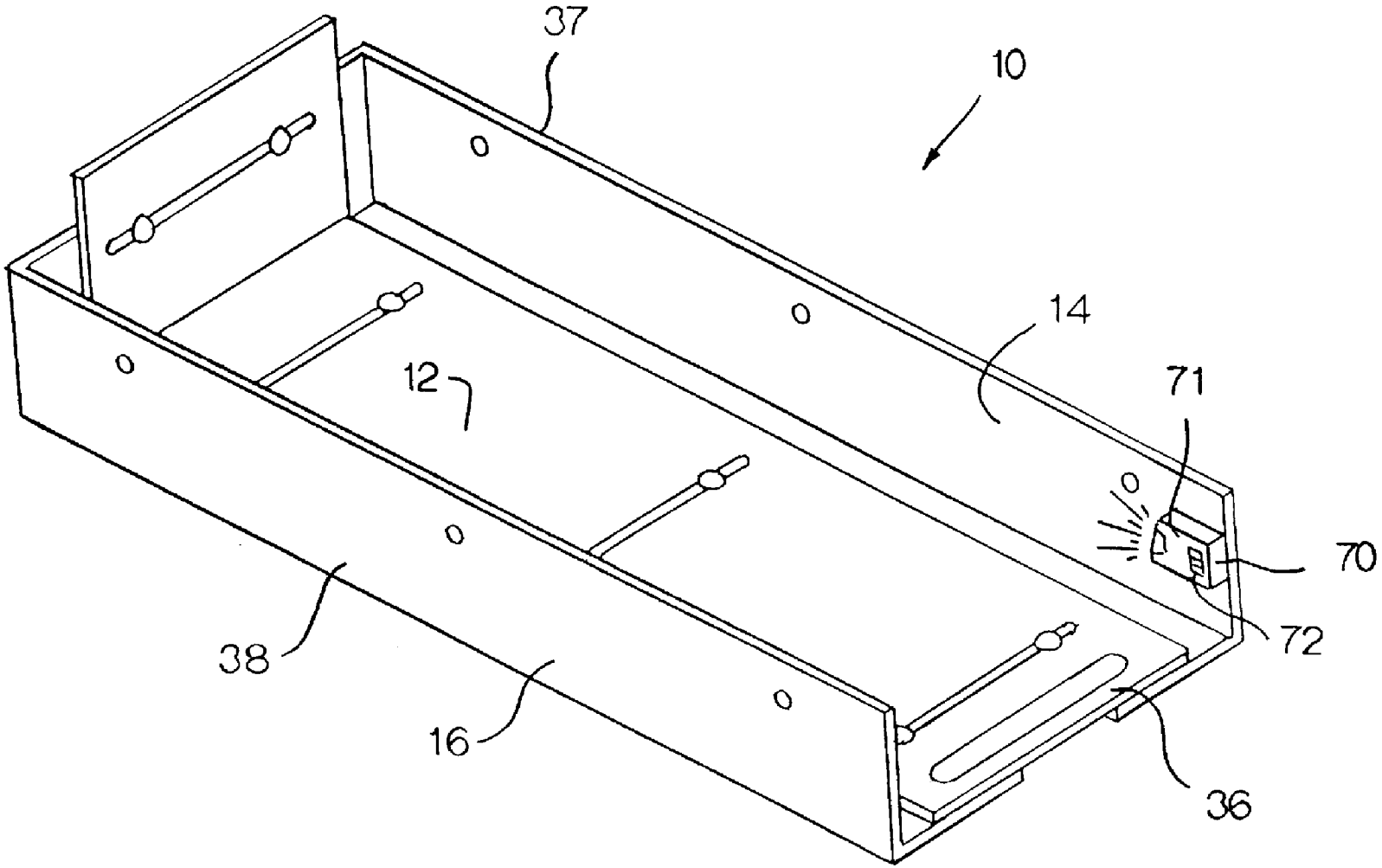
FIG. 8 is a perspective view of the mailbox tray in a wide configuration and including a light source mounted to the front of the tray.

Referring now to FIG. 8, in one embodiment, a light source 70, such as a battery powered LED flashlight, is removably coupled to the front of tray 10. Light source 70 is preferably mounted on the inner walls of side sections 14, 16 (e.g., to the inwardly-facing surfaces of walls 37, 38) to avoid the casing 71 of the light from interfering with the insertion and removal of the tray 10 from the mailbox 25 and reducing the interference of inserting mail into the tray 10. Light 70 includes an electrical on/off switch 72 to selectively illuminate the interior of the mailbox 25 and tray 10. Casing 71 is preferably coupled to tray 10 by conventional means, such as adhesive or mechanical fasteners.

From the foregoing description, one skilled in the art will readily recognize that the present invention is directed to a variable width mailbox tray that is readily adjustable to fit within substantially any rural or curbside mailbox. While the present invention has been described with particular reference to various preferred embodiments and with exemplary sizes and dimensions, one skilled in the art will recognize from the foregoing discussion and accompanying drawing, that changes, modifications and variations can be made in the present invention without departing from the spirit and scope thereof.

The invention claimed is:

1. A mailbox tray adapted to rest upon the floor of a mailbox, comprising:

a body having a flat elongated base strip and a rear wall projecting perpendicularly from the rearward edge of the base strip, the base strip including a plurality of spaced elongated slots running perpendicular to the long side of said base strip;

a pair of elongated side members, each side member comprising a taller wall and a shorter wall, said taller wall and shorter wall are joined along one longitudinal edge perpendicular to each other; and means for slidably coupling said side members to said body, whereby one of said side member walls abuts said base strip facewise, while the other side walls projects vertically upward and cooperates with said base strip and rear wall to define a mail-receiving cavity, the coupling means comprising a fastener having an enlarged head, said fastener passing through an aperture formed in the base strip abutting wall of said side member and through one of said slots, thereby fastening the side members to the body, whereby said slot permits lateral movement of the fastened side member relative to said body.

2. A mailbox tray as defined in claim 1, wherein said enlarged head is rounded and positioned beneath said base strip and said head separates a bottom of said base strip and said base strip abutting wall from said mailbox floor.

3. A mailbox tray as defined in claim 1, wherein each of said side members further comprises:

a back wall interposed along the rearward edges of said taller wall and shorter wall, said back wall joining said taller wall and shorter wall.

4. A mailbox tray as defined in claim 3, wherein said rear wall has an elongated slot that runs parallel to said base strip slots, wherein said fastener is a first fastener, and wherein each of said back walls abuts said rear wall facewise, said coupling means further comprising:

a second fastener passing through an aperture formed in each of the back walls and through said rear wall slot, whereby said rear wall slot permits lateral movement of the fastened side member relative to said body.

5. A mailbox tray as defined in claim 1, further comprising a light source mounted to a front end of said tray within said mail-receiving cavity.

6. An adjustable mailbox tray suited to fit within a mailbox having opposed side walls, comprising:

a body having a flat elongated base strip and a rear wall projecting perpendicularly from the rearward edge of the base strip, said base strip including at least two adjustment slots passing between a top surface through a bottom surface of said base strip, each adjustment slot running perpendicular to the long side of said base strip;

a first side member comprising an elongated first taller wall and an elongated first shorter wall, said first taller wall and first shorter wall are joined along one longitudinal edge perpendicular to each other;

a second side member comprising an elongated second taller wall and an elongated second shorter wall, said second taller wall and second shorter wall are joined along one longitudinal edge perpendicular to each other, wherein said second side member is a mirror-image of said first side member; and means for fastening one of said walls of said side members to said slots in said body, whereby said side members are movable laterally to narrow and widen a cavity defined by said body and said side members such that the other of said walls of the side members is a vertical outer wall of each of said side members and is proximate to one of said opposed mailbox side walls.

7. An adjustable mailbox tray as defined in claim 6, wherein said side members are coupled to said body by said fastening means through either of said taller wall or said shorter wall.

8. An adjustable mailbox tray as defined in claim 7, wherein either of said taller wall or said shorter wall abuts said base strip facewise and receives said fastening means through an aperture, and wherein the other wall in each side member extends vertically to define the vertical outer wall.

9. The adjustable mailbox tray as defined in claim 8, further comprising:

a first back wall interposed along and joining the rearward edges of said first taller wall and first shorter wall; and a second back wall interposed along and joining the rearward edges of said second taller wall and second shorter wall.

10. The adjustable mailbox tray as defined in claim 9, wherein both of said back walls abut said rear wall facewise.

11. The adjustable mailbox tray as defined in claim 10, wherein said rear wall includes an elongated adjustment slot that runs parallel to said base strip adjustment slots, wherein said fastening means further slidably couple said back walls to said rear wall slot.

12. The adjustable mailbox tray as defined in claim 6, wherein said fastening means include a foot portion mounted beneath said bottom surface of the base strip, wherein said foot portion offset said bottom surface from a floor of said mailbox.

13. The adjustable mailbox tray as defined in claim 6, further comprising means for grasping the front of the tray.

14. The adjustable mailbox tray as defined in claim 6, wherein said fastening means further include a plurality of apertures formed in said taller walls and said shorter walls, each aperture in said walls is aligned with one of said plurality of slots when its wall abuts said base strip facewise.

15. A method of fitting an adjustable mailbox tray within a mailbox having opposed side walls, such that the side walls of the tray are proximate to said opposed side walls, said method comprising the steps of:

providing an elongated base strip having a plurality of slots running perpendicular to a longitudinal side of said base strip;

providing a pair of elongated side members, each of said side members having a taller wall and a shorter wall that extends perpendicularly from a longitudinal edge of said taller wall, each of said side member walls including a plurality of apertures formed therethrough;

selecting either said taller wall or said shorter wall to abut said base strip by measuring how far apart said opposed mailbox walls are;

abutting said selected side member wall to said base strip facewise, such that said selected side member wall apertures are aligned with one of said plurality of slots and the non-selected side member wall extends vertically upward, whereby the non-selected side member wall forms the side walls of the tray;

adjusting the gap between the side walls of the tray until each of the side walls of the tray are proximate to one of said opposed mailbox walls;

providing at least one fastener; and fastening said side members to said base strip by inserting one of said fasteners through said aligned apertures and slots.

16. A mailbox tray adapted to rest upon the floor of a mailbox, comprising:

a body having a flat elongated base strip and a rear wall projecting perpendicularly from the rearward edge of the base strip;

a pair of elongated side members, each side member comprising a taller wall, a shorter wall, and a back wall, said taller wall and shorter wall are joined along one longitudinal edge perpendicular to each other, and the back wall is interposed along the rearward edges of said taller wall and shorter wall, to join said taller wall and shorter wall; and means for slidably coupling said side members to said body, whereby one of said side member walls abuts said base strip facewise, while the other side walls projects vertically upward and cooperates with said base strip and rear wall to define a mail-receiving cavity.

17. A mailbox tray as defined in claim 16, wherein said base strip includes a plurality of spaced elongated slots running perpendicular to the long side of said base strip, said coupling means comprising:

a fastener having an enlarged head, said fastener passing through an aperture formed in the base strip abutting wall of said side member and through one of said slots, whereby said slot permits lateral movement of the fastened side member relative to said body, wherein said enlarged head is rounded and positioned beneath said base strip and said head separates a bottom of said base strip and said base strip abutting wall from said mailbox floor.

18. A mailbox tray as defined in claim 16, wherein said rear wall has an elongated slot that runs parallel to said base strip slots, wherein said fastener is a first fastener, and wherein each of said back walls abuts said rear wall facewise, said coupling means further comprising:

a second fastener passing through an aperture formed in each of the back walls and through said rear wall slot, whereby said rear wall slot permits lateral movement of the fastened side member relative to said body.

19. A mailbox tray as defined in claim 16, further comprising a light source mounted to a front end of said tray within said mail-receiving cavity.

20. A mailbox tray adapted to rest upon the floor of a mailbox, comprising:

a body having a flat elongated base strip and a rear wall projecting perpendicularly from the rearward edge of the base strip;

a pair of elongated side members, each side member comprising a taller wall and a shorter wall, said taller wall and shorter wall are joined along one longitudinal edge perpendicular to each other;

means for slidably coupling said side members to said body, whereby one of said side member walls abuts said base strip facewise, while the other side walls projects vertically upward and cooperates with said base strip and rear wall to define a mail-receiving cavity; and a light source mounted to a front end of said tray within said mail-receiving cavity.

21. A mailbox tray as defined in claim 20, wherein said base strip includes a plurality of spaced elongated slots running perpendicular to the long side of said base strip, said coupling means comprising:

a fastener having an enlarged head, said fastener passing through an aperture formed in the base strip abutting wall of said side member and through one of said slots, whereby said slot permits lateral movement of the fastened side member relative to said body, wherein said enlarged head is rounded and positioned beneath said base strip and said head separates a bottom of said base strip and said base strip abutting wall from said mailbox floor.

22. A mailbox tray as defined in claim 21, wherein each of said side members further comprises a back wall interposed along the rearward edges of said taller wall and shorter wall, said back wall joining said taller wall and shorter wall; and wherein said rear wall has an elongated slot that runs parallel to said base strip slots, wherein said fastener is a first fastener, and wherein each of said back walls abuts said rear wall facewise, said coupling means further comprising:

a second fastener passing through an aperture formed in each of the back walls and through said rear wall slot, whereby said rear wall slot permits lateral movement of the fastened side member relative to said body.

* * * * *